US006969155B2

(12) United States Patent
Umezawa

(10) Patent No.: US 6,969,155 B2
(45) Date of Patent: Nov. 29, 2005

(54) PRINTING APPARATUS AND PRINT CONTROL METHOD

(75) Inventor: Masahiko Umezawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 10/620,352

(22) Filed: Jul. 17, 2003

(65) Prior Publication Data

US 2004/0021719 A1 Feb. 5, 2004

(30) Foreign Application Priority Data

Jul. 30, 2002 (JP) ..... 2002-222022

(51) Int. Cl.[7] ..... B41J 2/05; B41J 29/38
(52) U.S. Cl. ..... 347/61; 347/11
(58) Field of Search ..... 347/9–11, 14, 15, 347/17, 60, 61

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.
5,880,762 A * 3/1999 Ishinaga et al. ..... 347/62
5,896,146 A 4/1999 Murata et al.
6,382,755 B1 * 5/2002 Imanaka et al. ..... 347/12

FOREIGN PATENT DOCUMENTS

JP 9-11504 1/1997

* cited by examiner

*Primary Examiner*—Stephen Meier
*Assistant Examiner*—An H. Do
(74) *Attorney, Agent, or Firm*—Fitzpatrick, Cella, Harper & Scinto

(57) ABSTRACT

A printing apparatus and a print control method can obtain excellent ink discharge without reducing the life of a printhead for image formation using plural sizes of ink droplets. Unop printing by discharging ink from an ink-jet printhead, having plural printing elements capable of discharging ink droplets in plural sizes, to a print medium, the number of concurrently-driven printing elements is counted corresponding to each respective size of the plural sizes, based on input print data, then a drive pulse applied to the concurrently-driven printing elements corresponding to the respective size of the plural sizes is determined based ont he result of counting, and the drive pulse is applied to the concurrently-driven printing elements.

10 Claims, 13 Drawing Sheets

FIG. 9

| SH | | | LH | | |
|---|---|---|---|---|---|
| REGISTER VALUE | | COEFFICIENT | REGISTER VALUE | | COEFFICIENT |
| 0 | 0 | 8/8 | 0 | 0 | 8/8 |
| 0 | 1 | 9/8 | 0 | 1 | 7/8 |
| 1 | 0 | 10/8 | 1 | 0 | 6/8 |
| 1 | 1 | 12/8 | 1 | 1 | 5/8 |

FIG. 10

111'

| PULS TABLE No | | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|---|
| ON_Time2 (μS) | L HEATER | 2.00 | 2.02 | 2.04 | 2.06 | ---------- | | | | | | 2.20 | 2.22 | 2.24 | 2.26 | 2.28 | 2.30 | | | | |
| | S HEATER | 1.80 | 1.82 | 1.84 | 1.86 | ---------- | | | | | | | | | | 2.08 | 2.10 | 2.12 | 2.14 | 2.16 | 2.18 |

PRINTING APPARATUS AND PRINT CONTROL METHOD

CLAIM OF PRIORITY

This application claims priority under 35 U.S.C. §119from Japanese Patent Application No. 2002-222022 filed on Jul. 30, 2002, entitled "Printing Apparatus and Print Control Method", which is incorporated herein by reference.

FIELD OF THE INVENTION

The present invention relates to a printing apparatus and a print control method, and more particularly, to a printing apparatus and a print control method for performing printing using an ink-jet printhead.

BACKGROUND OF THE INVENTION

Generally, an ink-jet printing apparatus has a carriage holding a printhead and an ink tank, conveyance means for conveying a print medium such as a print sheet, and control means for controlling these elements. In the ink-jet printing apparatus, printing is performed by scanning an ink-jet printhead (hereinafter referred to as a "printhead"), having plural ink discharge nozzles (hereinafter referred to as "nozzles") to discharge ink droplets, in a direction (main scanning direction) perpendicular to a print medium conveyance direction (subscanning direction) while ink is discharged to the print medium. At this time, as a large number of nozzles to discharge ink are arrayed on a straight line in the subscanning direction, printing is performed for a width corresponding to the number of nozzles by scanning of the printhead on the print medium once. Accordingly, the printing speed can be easily increased by increasing the number of nozzles and increasing the printing width of the printhead.

Further, in a printhead where plural printing elements are arrayed in a line, these plural printing elements are divided into plural groups, and the plural groups are time-divisionally driven, sequentially, thereby a printing operation is performed. The number of concurrently-driven printing elements and the number of nozzles to perform concurrent ink discharge are determined in accordance with the number of groups of printing elements.

In the ink-jet printing apparatus, it is assumed under the condition that an environmental temperature and the temperature of the printhead are constant that the same printing density can be obtained by applying the same amount of energy to the printing elements. However, in a case where plural printing elements are divided into plural groups and the groups are time-divisionally driven as described above, the number of concurrently-driven printing elements within one group changes in accordance with an image signal inputted into the printhead. If the number of concurrently-driven printing elements is increased, the amount of an electric current which flows through a common conductor to supply drive power to the plural printing elements is increased.

As a result, a drive voltage applied to the respective printing elements drops, and the energy applied to the printhead is changed, thus a variation occurs in the printing density.

Assuming that a resistance value of the common conductor is R, and a current which flows through one printing element is I, the voltage drop ($V_{drop}$) is expressed as $$V_{drop}=R*I$$

Accordingly, in a case where n printing elements are concurrently driven, the voltage drop ($V_{drop}$_n) is expressed as $$V_{drop}_n=R*nI.$$

When all the printing elements belonging to a time-divisionally driven group are driven, i.e., when the number of concurrently-driven printing elements is a maximum (when the drive voltage drop is maximum), in order to realize stable ink discharge, the energy applied to the printhead is determined in consideration of the maximum number of concurrently-driven printing elements. However, in the case where the energy applied to the printhead is determined in this manner, if only one printing element is driven, excessive energy is applied to the printing element, which harmfully affects the durability of the printing element.

Conventionally, as a countermeasure to this drawback, Japanese Published Unexamined Patent Application No. Hei 9-11504 discloses measuring the number of concurrently-driven printing elements in one group and determining a parameter for a drive pulse to be applied to the printing elements in correspondence with the measured number. In this manner, the energy applied to the printhead is changed in correspondence with the number of concurrently-driven printing elements, thereby maintaining the durability of the printing elements and stabilizing the printing density.

In recent years, there is an increasing need for higher image quality, and in response to the need, the size of discharged ink droplets is reduced using various methods in the ink-jet apparatus. For example, if printing is performed on a print sheet using small size ink droplets, a high-quality image without graininess can be obtained in a low printing duty area, while in a high printing duty area, as an image with sufficient density cannot be formed by one ink discharge, the image must be formed by more than one ink discharge. As a result, the printing speed is lowered.

Accordingly, to achieve high-speed printing and high-quality printing, a printing apparatus which forms an image using ink droplets in plural sizes is proposed.

Assuming that a heater resistor of a printing element to discharge a large size of ink droplet is r1, that of a printing element to discharge a small size of ink droplet, r2, a drive voltage, VH, and a resistance value of a common conductor to supply drive power, R, an electric current I1 which flows through the heater resistor r1 and an electric current I2 which flows through the heater resistor r2 are expressed as $$I1=VH/r1, \text{ and } I2=VH/r2,$$

and the respective voltage drops ($V_{drop1}$ and $V_{drop2}$) are expressed as $$V_{drop1}=I1*R, \text{ and } V_{drop2}=I2*R$$

That is, the voltage drop values are different.

FIG. 12 is a graph showing the relation between the number of concurrently-driven printing elements and the voltage drop.

In FIG. 12, 1200*a* denotes a voltage drop by the heater resistor r1, and 1200*b*, *a* voltage drop by the heater resistor r2. The difference between these voltage drops increases in correspondence with the number of concurrently-driven printing elements.

In this manner, in a printing apparatus which forms an image using ink droplets in plural sizes, the voltage drop values, which occur in the printing elements used for discharging the respective size ink droplets, are different. Accordingly, it is desirable to set an optimum drive parameter to define the drive pulse to be applied to the printing elements in correspondence with the number of concurrently-driven printing elements.

SUMMARY OF THE INVENTION

Accordingly, the present invention is conceived as a response to the above-described disadvantages of the conventional art.

For example, a printing apparatus and a print control method according to the present invention is capable of forming an image using ink droplets in plural sizes, which obtain excellent discharge without reducing the life of printhead.

According to one aspect of the present invention, the foregoing object is attained by providing a printing apparatus for performing printing by discharging ink from an ink-jet printhead, having plural printing elements capable of discharging ink droplets in plural sizes, to a print medium, comprising: input means for inputting print data; count means for counting the number of concurrently-driven printing elements corresponding to the respective one of the plural sizes, based on the print data inputted by the input means; determination means for determining a drive pulse applied to the concurrently-driven printing elements corresponding to the respective one of the plural sizes, based on the result of counting by the count means; and print means for performing printing by applying the drive pulse determined by the determination means to the concurrently-driven printing elements.

It may be preferable that in the printing means, the plural printing elements are divided into plural blocks, and the plural printing elements are time-divisionally driven in block units using a double pulse, and that the count means counts the number of printing elements concurrently-driven in block units.

Accordingly, to actually perform the above counting, it may be preferable that the count means further includes: a first counter that counts the number of concurrently-driven printing elements, among a first group of printing elements corresponding to discharge of first size of ink droplets, in block units; and a second counter that counts the number of concurrently-driven printing elements, among a second group of printing elements corresponding to discharge of second size of ink droplets.

Further, it is preferable that the determination means determines a waveform of a double pulse applied to the first group of printing elements and the second group of printing elements, based on the result of counting by the first counter and the result of counting by the second counter, by, e.g., determining a main pulse width.

Note that upon the above determination, it is preferable that the determination means further includes storage means for storing plural main pulse widths, and the determination means performs a weighting operation on the result of counting by the first counter and the result of counting by the second counter, and accesses the storage means based on the result of the weighting operation to determine a main pulse width to be applied to the first group of printing elements, while the determination means performs another weighting operation on the result of counting by the first counter and the result of counting by the second counter, and accesses the storage means based on the result of another weighting operation to determine a main pulse width to be applied to the second group of printing elements.

Further, it may be preferable that the ink-jet printhead has a nozzle array in which a first type of nozzle to discharge a first size of ink droplets and a second type of nozzle to discharge a second size of ink droplets are alternately arrayed. In this case, the first type of nozzle has a first type of electrothermal transducer to generate thermal energy to be supplied to ink for discharging the first size of ink droplets utilizing the thermal energy, and the second type of nozzle has a second type of electrothermal transducer to generate thermal energy to be supplied to ink for discharging the second size of ink droplets utilizing the thermal energy.

According to another aspect of the present invention, the foregoing object is attained by providing a print control method for performing printing by discharging ink from an ink-jet printhead, having plural printing elements capable of discharging ink droplets in plural sizes, to a print medium, comprising: an input step of inputting print data; a count step of counting the number of concurrently-driven printing elements corresponding to the respective one of the plural sizes, based on the print data inputted at the input step; a determination step of determining a drive pulse applied to the concurrently-driven printing elements corresponding to the respective one of the plural sizes, based on the result of counting at the count step; and a control step of performing printing by applying the drive pulse determined at the determination step to the concurrently-driven printing elements.

In accordance with the present invention as described above, in a case where printing is performed by discharging ink to a print medium from an ink-jet printhead having plural printing elements, capable of discharging ink droplets in plural sizes, the number of concurrently-driven printing elements among printing elements corresponding to the respective one of the plural sizes of ink droplets is counted based on input print data, then based on the counted result, a drive pulse to be applied to the concurrently-driven printing elements is determined, and the drive pulse is applied to the concurrently-driven printing elements.

The invention is particularly advantageous since an optimum drive pulse can always be applied to printing elements corresponding to the respective one of plural sizes of ink droplets.

In this manner, a stable printing density can be obtained without degradation of printing elements.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 9 is a table showing coefficients selected based on values set in a register 601;

FIG. 10 is a table showing the internal structure of a heat table 111';

DETAILED DESCRIPTION OF THE PREFERRED EMBODIMENT

A preferred embodiment of the present invention will now be described in detail in accordance with the accompanying drawings.

Note that the following embodiment exemplifies a printing apparatus which employs an inkjet printhead.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Figure 1A:
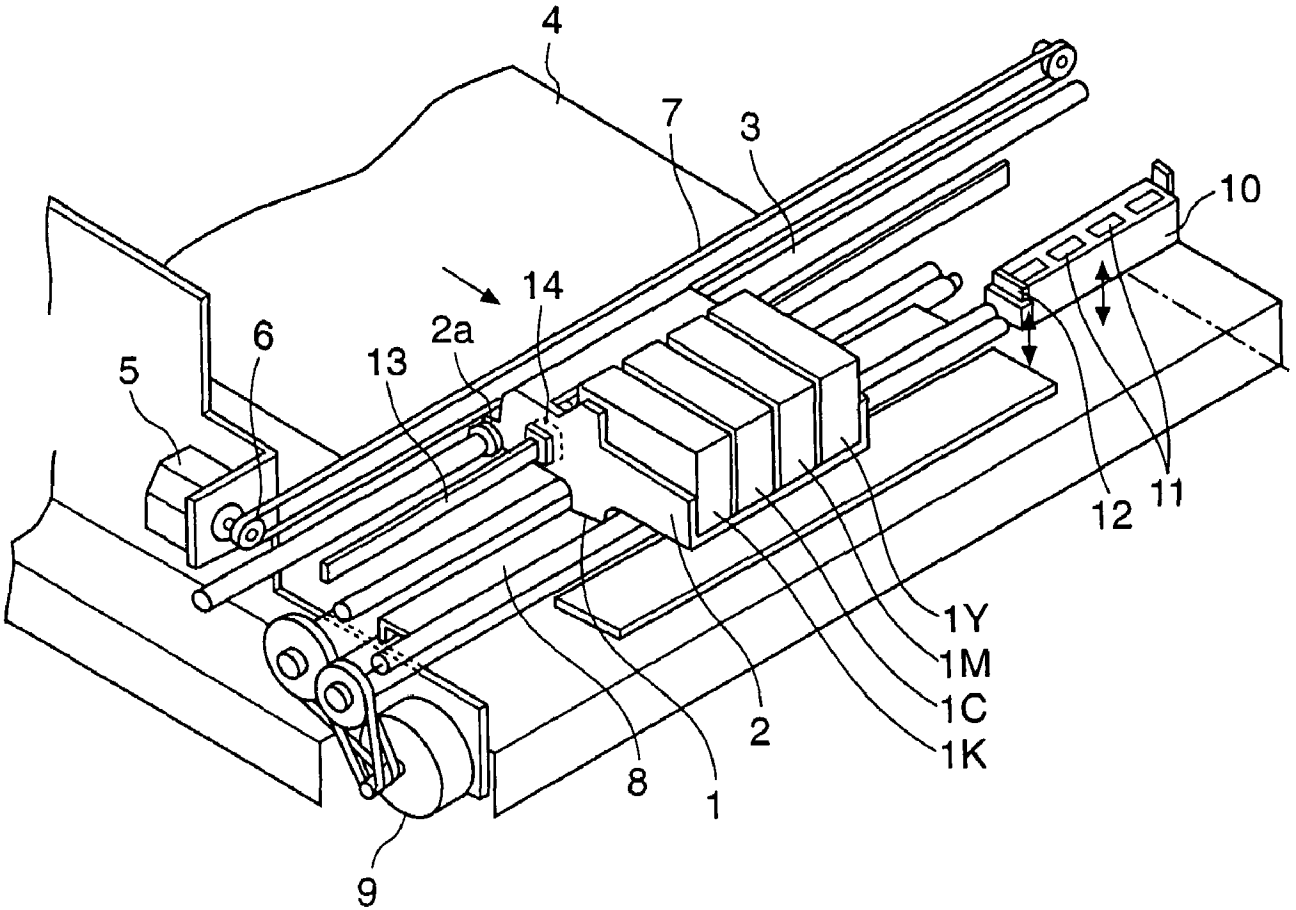
FIG. 1A is a perspective view showing the schematical structure of an ink-jet printing apparatus as a typical embodiment of the present invention.

FIG. 1A is a perspective view showing the schematical structure of an ink-jet printing apparatus (hereinafter, referred to as a "printing apparatus") as a typical embodiment of the present invention.

A printhead 1 used in this embodiment discharges ink droplets by thermal energy, based on a method, among ink-jet printing methods, of particularly heating ink by using electrothermal transducers such as heat generation resistors as energy generation means, thereby realizing high resolution and high accuracy in printed images.

As shown in FIG. 1A, the printhead 1 is connected to an ink tank 1C containing cyan (C) ink, an ink tank 1M containing magenta (M) ink, an ink tank 1Y containing yellow (Y) ink and an ink tank 1K containing black (Bk) ink. The printhead 1 and the ink tanks 1C, 1M, 1Y and 1K are mounted on a carriage 2. As shown in FIG. 1A, these four ink tanks are arrayed along a lengthwise direction of a guide shaft 3, i.e., along a moving direction of the carriage 2.

As shown in FIG. 1A, the printhead 1, in a position to discharge ink downward, is mounted on the carriage 2. When a bearing 2*a* of the carriage 2 moves along the guide shaft 3, the printhead 1 discharges ink droplets, to form an image for one scanning on a print medium 4 such as a print sheet. Note that reciprocating motion of the carriage 2 along the guide shaft 3 is performed via a timing belt 7 by rotation of a pulley 6 which receives a driving force transmitted from a carriage motor 5.

When printing by one scanning by the printhead 1 has been completed, the printhead 1 stops printing. At this time, a conveyance motor 9 is driven, and the print medium 4 on a platen 8 is conveyed by a predetermined amount in a direction vertical to the moving direction of the carriage 2. Then, the printhead 1 performs the next image formation for one scanning while the carriage 2 moves along the guide shaft 3. These operations are repeated until an image is printed on the entire print medium 4.

In FIG. 1A, on the right side of the main body of the printing apparatus, a recovery device 10 which performs recovery operation for maintaining a good ink discharge condition is provided. The recovery device 10 is provided with preliminary discharge orifices (not shown) for preliminary discharge for prevention of clogging on its side. The recovery device 10 includes a cap 11 for capping an ink discharge surface of the printhead 1, a wiper 12 for wiping the ink discharge surface of the printhead 1, a suction pump (not shown) for sucking ink from the ink discharge nozzles (hereinafter referred to as "nozzles") of the printhead 1, and the like.

Further, the printing apparatus of this embodiment has an encoder scale 13 and an encoder 14 to detect a moving speed of the carriage 2, and performs feed-back control of the carriage motor 5 upon driving of the motor. Further, as the encoder 14 reads position information of the encoder scale 13, an ink discharge timing from the printhead 1 (hereinafter referred to as "heat timing") is obtained.

Note that the printhead 1 used in the embodiment is a color printhead for color printing, supplied with four color inks from the above-described four ink tanks, in which one nozzle array corresponds to one color ink. The respective nozzle arrays (4 arrays) are arrayed in the moving direction of the carriage 2.

Figure 1B:
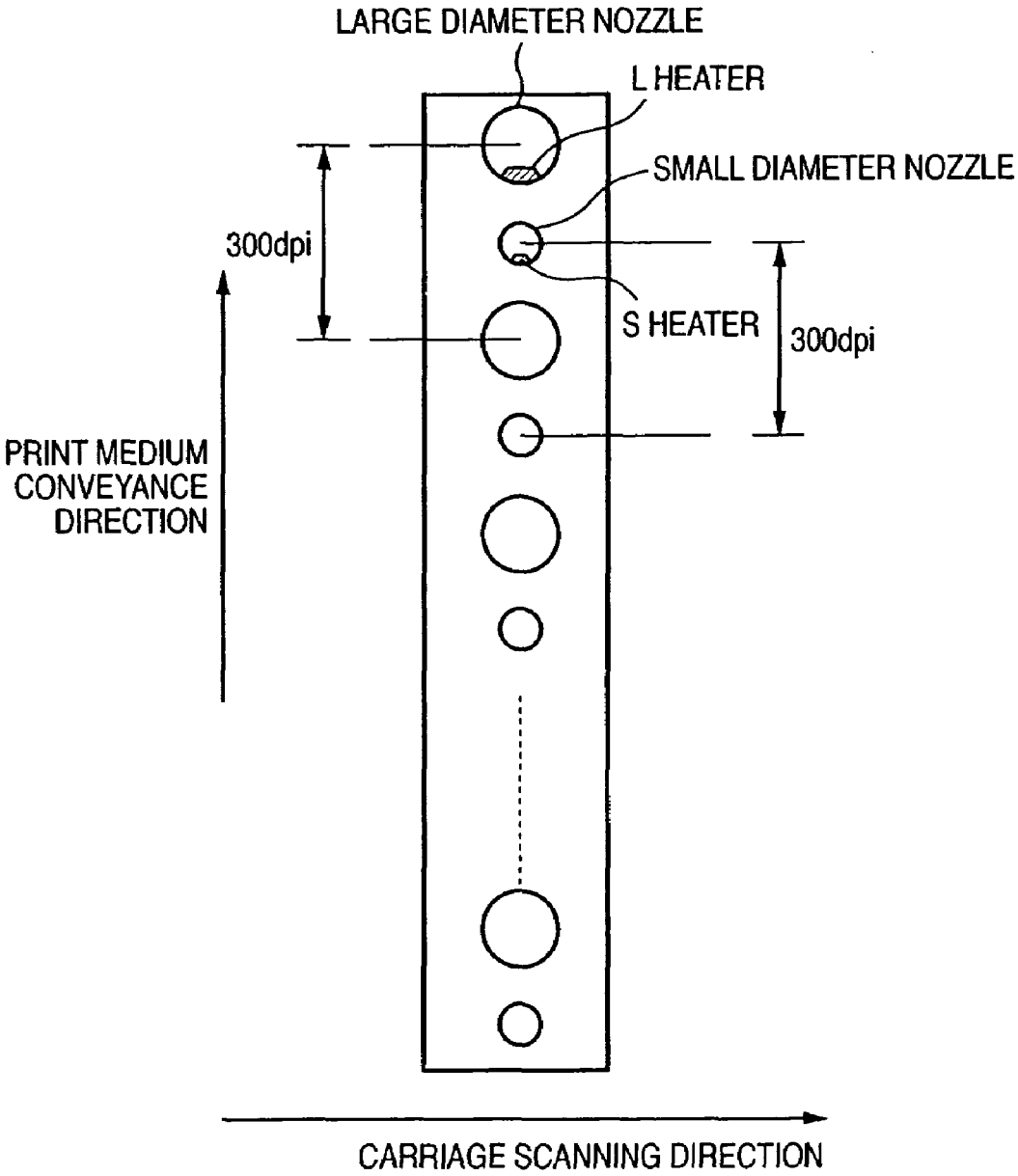
FIG. 1B is a schematic diagram showing an example of nozzle arrangement in a printhead.

FIG. 1B is a schematic diagram showing an example of the nozzle arrangement to discharge the black (Bk) ink in the printhead 1.

In FIG. 1B, the nozzle array to discharge the black (Bk) ink includes a large diameter nozzle to discharge large ink droplets and a small diameter nozzle to discharge small ink droplets arranged alternately in its array direction (the conveyance direction of the print medium). The resolution between the large diameter nozzles is 300 dpi, and that between the small diameter nozzles is 300 dpi. The large diameter nozzles and the small diameter nozzles are respectively provided with a heater used for discharging large ink droplets (hereinafter, "L heater") and a heater used for discharging small ink droplets (hereinafter, "S heater").

Figure 2:
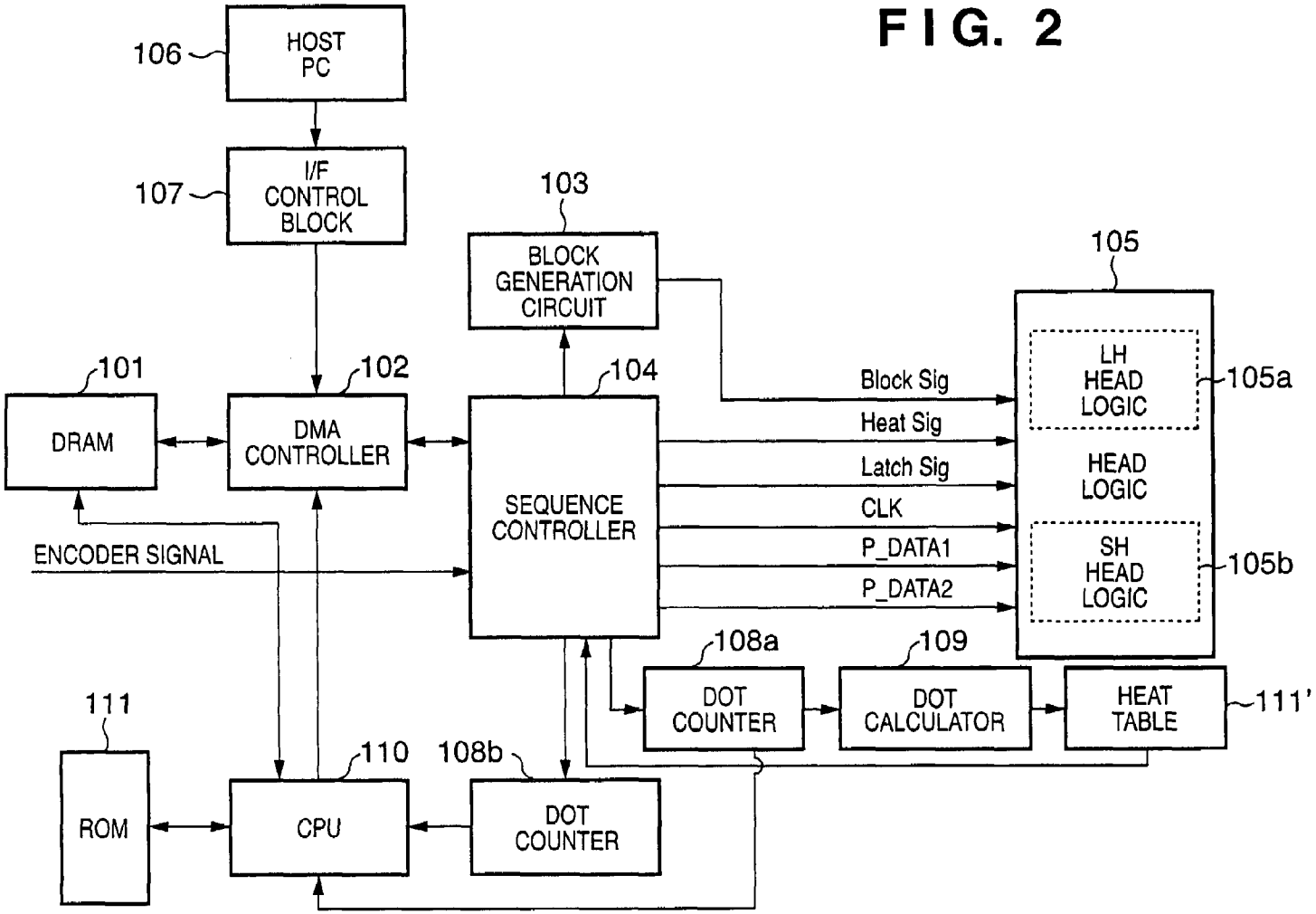
FIG. 2 is a block diagram showing a control construction of the printing apparatus in FIG. 1A.

FIG. 2 is a block diagram showing a control construction of the printing apparatus in FIG. 1A.

In the construction in FIG. 2, print data (color print data) sent from a host PC 106 is received by an interface (hereinafter "I/F") control block 107 in the printing apparatus. The received data is bitmapped to print data of respective color components (YMCBk), and the bitmap data are transferred to a DRAM 101 by a DMA controller 102 and temporarily stored in the DRAM 101 under the control of a CPU 110.

The bitmapped print data stored in the DRAM 101 are read by the DMA 102, while an encoder signal is inputted for detection of the position of the printhead 1, and transferred to a head logic 105 of the printhead 1 via a sequence controller 104. At this time, the transferred data is outputted as print signals (P_DATA1 and P_DATA2) in accordance with a clock signal (CLK) from the sequence controller 104. Then, after the data transfer, a latch signal (Latch Sig) is outputted to the head logic 105, and the print signals are latched by a latch circuit (not shown) in the head logic 105.

On the other hand, the sequence controller 104 generates a block selection signal (Block Sig) by a block generation circuit 103, outputs the signal to the head logic 105 and also outputs a heat signal (Heat Sig) to the head logic 105. In accordance with these signals, the large number of printing elements are divided into plural blocks and time-divisional block driving is performed.

Note that the head logic 105 is a head control logic to drive printing elements for one array (corresponding to one color component) among four nozzle arrays in the printhead 1. Actually, four head logics 105 are built in the printhead 1, however, for simplicity of explanation, only one head logic is shown. Further, one head logic 105 has an LH head logic 105*a* and an SH head logic 105*b* for respectively driving the L heaters and S heaters of the respective nozzles.

Upon start of printing operation, a dot counter 108*a* respectively counts the number of ink discharges using the L heaters (Lcount) and the number of ink discharges using the S heaters (Scount) by each transfer of print data to the print head, based on the bitmapped print data. The results of counting by the dot counter 108*a* are inputted into a dot calculator 109, in which the results are multiplied by predetermined coefficients. The results of multiplication are inputted into a heat table 111', and heat setting values are read from the heat table 111' in correspondence with the results of multiplication. The read values are fed-back to the sequence controller 104.

On the other hand, a dot counter 108*b* accumulates the number of ink discharges performed by the plural printing elements of the printhead, by each transfer of print data to the printhead, and the result of accumulation is used for estimation of a temperature of the printhead and detection of residual ink amount by the CPU 110. As this counter accumulates the number of ink discharges, it keeps the count from several hundred thousands to several millions.

Figure 3:
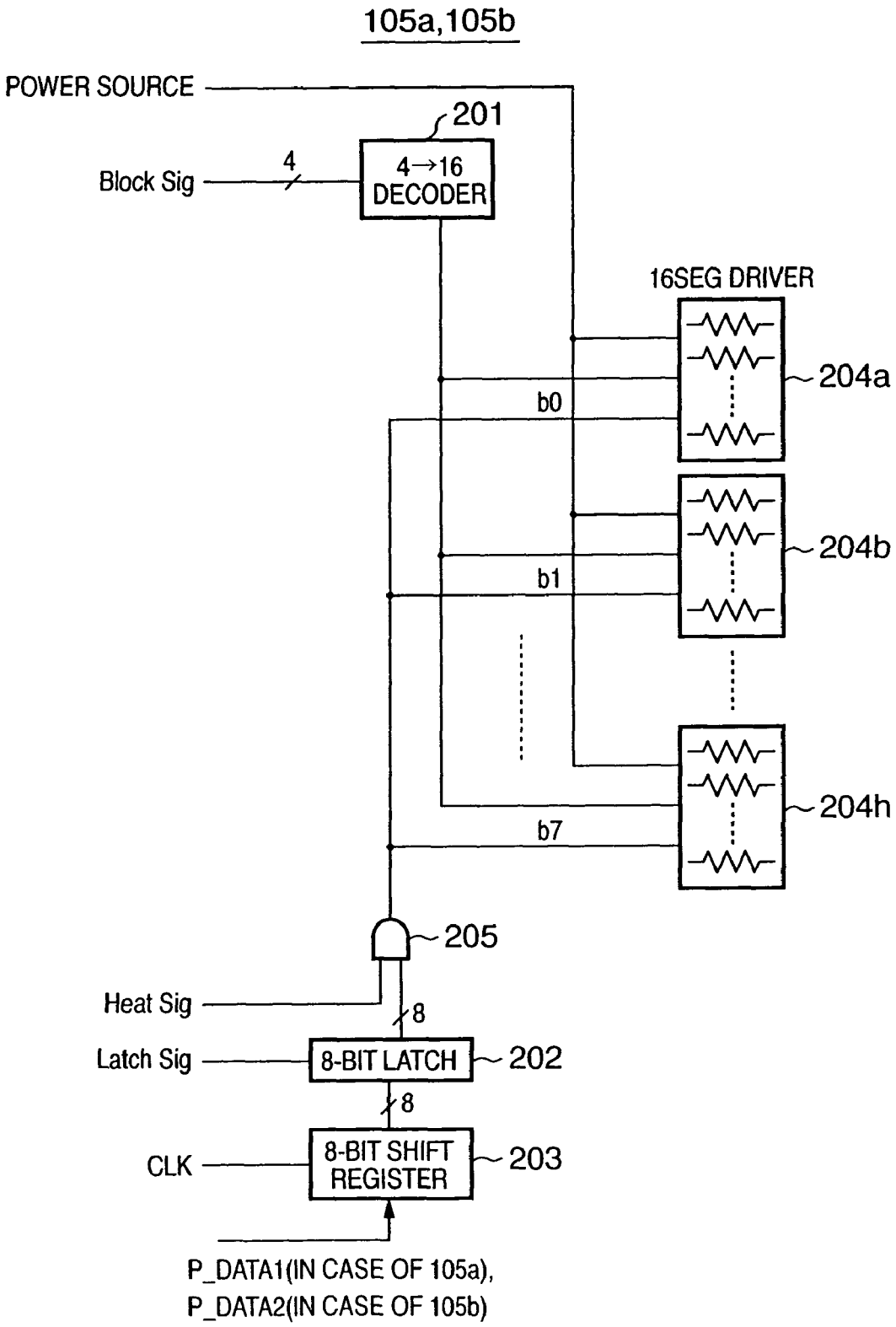
FIG. 3 is a block diagram showing the internal constructions of a head logic 105*a* and a head logic 105*b;*

FIG. 3 is a block diagram showing internal constructions of the head logic 105*a* and the head logic 105*b*. Further, FIG. 4 is a timing chart showing various signals used in the head logic 105 and the dot counter 108*a*.

The head logic 105*a* and the head logic 105*b* are respectively provided with 16-SEG drivers 204*a* to 204*h* for driving the heaters of the 16 printing elements. These eight drivers are supplied with driving power via a common power source line.

Figure 4:
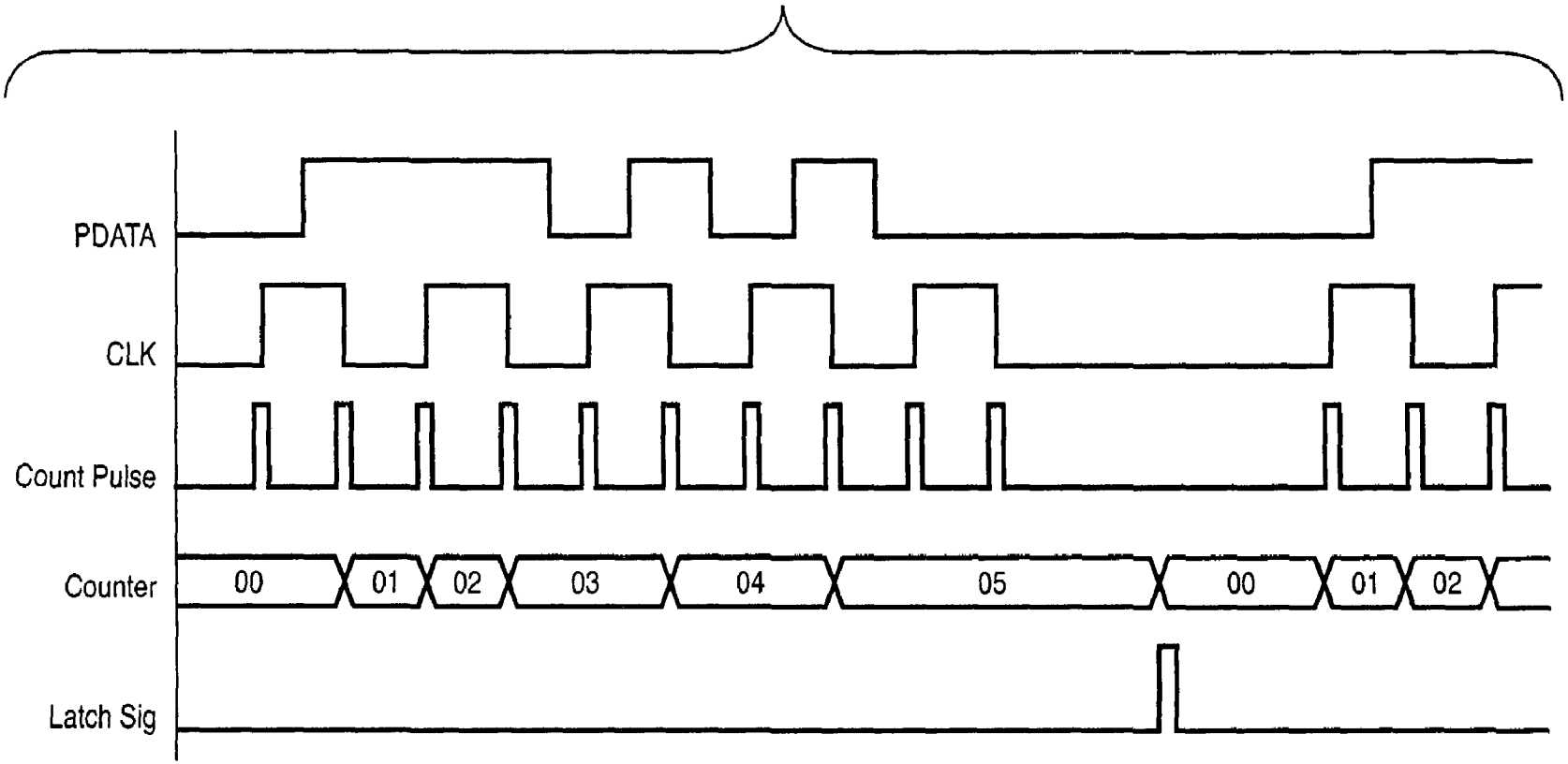
FIG. 4 is a timing chart showing various signals used in a head logic 105 and a dot counter 108*a;*

On the other hand, as shown in FIG. 4, the print signal P_DATA1 (in case of the head logic 105*a*) or the print signal P_DATA2 (in case of the head logic 105*b*), serially inputted into an 8-bit shift register 203 in synchronization with the clock signal (CLK), is latched by an 8-bit latch circuit 202 by the latch signal (Latch Sig). When the heat signal (Heat Sig) is supplied to an AND circuit 205, respective bits b0 to b7 of the latched 8-bit print signal are supplied to the eight drivers. In FIG. 4, the print signal is simply indicated as PDATA without discrimination between the head logic 105*a* and the head logic 105*b* as a destination.

Further, the 4-bit block selection signal (Block Sig) is decoded by a 4 to 16 decoder 201 and supplied to the eight drivers 204*a* to 204*h*.

Note that the eight 16-SEG drivers 204*a* to 204*h* have the same construction.

Further, as shown in FIG. 4, in the dot counter 108*a*, the count value (Counter) is incremented when a count pulse (Count Pulse) generated based on the clock signal (CLK) and the print signal (PDATA) are at a high level, and the count value is reset to "zero" when the latch signal (Latch Sig) becomes the high level. In this example, only one count output value is shown for simplicity of explanation; however, Lcount and Scount are actually outputted. Processing of the count outputs will be described in detail later.

Figure 5:
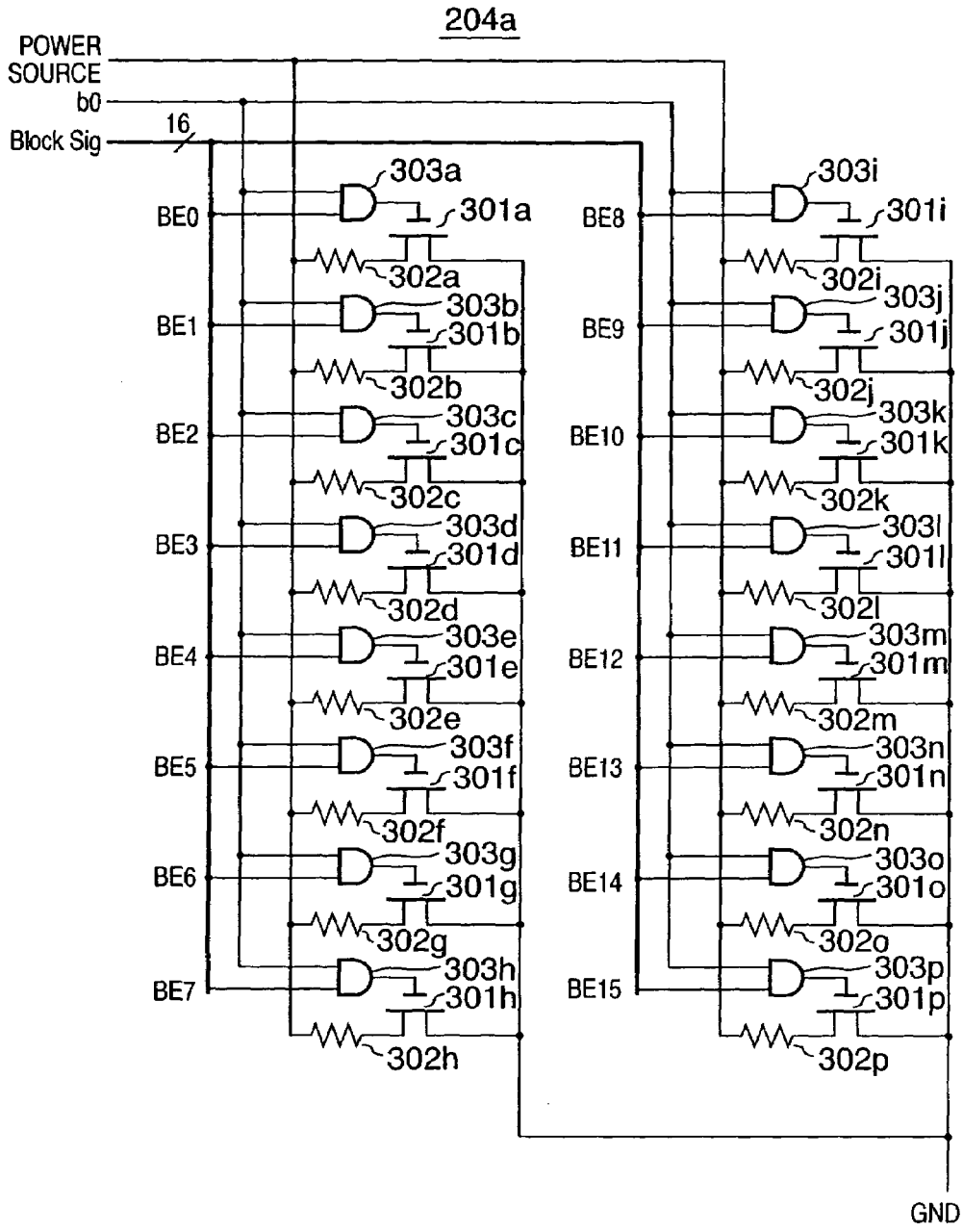
FIG. 5 is a block diagram showing the internal construction of a 16-SEG driver 204*a;*

FIG. 5 is a block diagram showing the construction of the 16-SEG driver 204*a*.

As shown in FIG. 5, the 16 printing elements are respectively constructed with one power transistor, one resistor (heater) and one AND circuit having reference numerals 301*a* to 301*p*, 302*a* to 302*p*, and 303*a* to 303*p*.

In FIG. 5, the bit b0 of the latched 8-bit print signal is inputted into one terminal of the 16 AND circuits 303*a* to 303*p*, and the power source line is connected to the 16 resistors (heaters) 302*a* to 302*p*. Further, respective bits (BE0 to BE15) of the block selection signal decoded by the 4 to 16 decoder 201 are inputted into the other terminals of the AND circuits 303*a* to 303*p*. Further, the power transistors 301*a* to 301*p* are connected to the GND.

In this arrangement, if the input print signal b0 is ON, the power transistor corresponding to "ON" signal among the block selection signals (BE0 to BE15) is driven, and as a result, a corresponding heater is heated, and ink discharge is performed.

Figure 6:
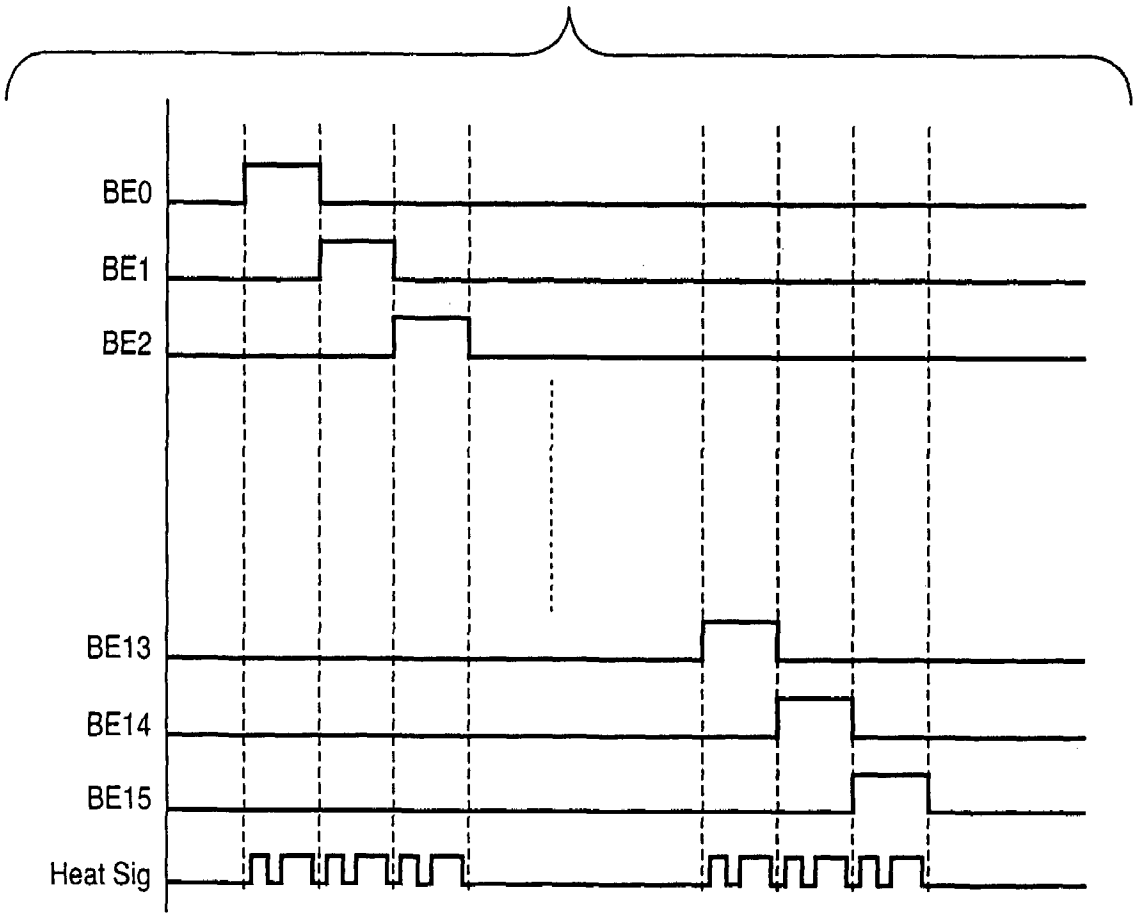
FIG. 6 is a timing chart showing a BEn signal.

FIG. 6 is a timing chart showing the BEn signal.

In FIG. 6, as power transistors corresponding to the decoded block selection signals (BE0 to BE15) are sequentially driven, the resistors (heaters) 302*a* to 302*p* are sequentially heated, and ink discharge is performed.

Note that the heat signal (Heat Sig) has a double pulse waveform.

Figure 7:
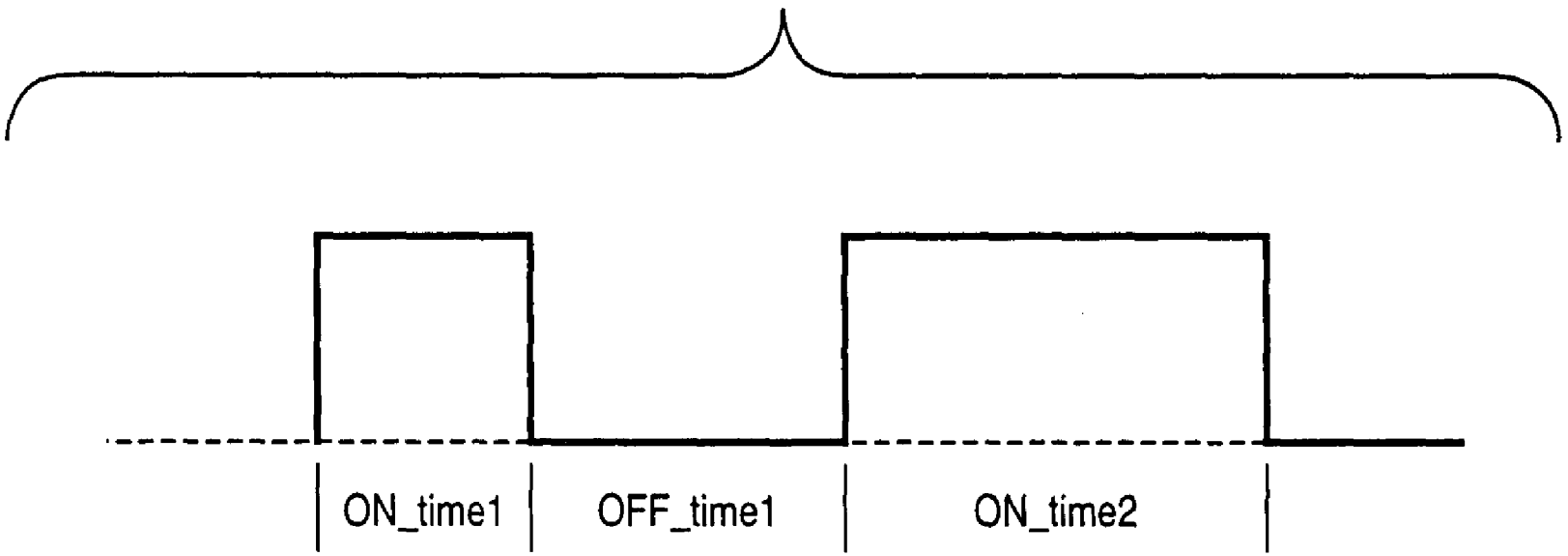
FIG. 7 is a timing chart showing a detailed waveform of a heat signal (Heat Sig) having a double pulse.

FIG. 7 is a timing chart showing a detailed waveform of the heat signal (Heat Sig) having a double pulse.

In double-pulse drive of performing ink discharge by application of double pulse, preliminary ink heating performed by a pulse ON_time1 (prepulse) attains more stable discharge. Further, ink discharge is actually performed by a pulse ON_time2 (main pulse). In this embodiment, the pulse width of the main pulse is varied in accordance with the number of concurrently-driven printing elements.

Note that as the pulse width modulation, all of the prepulse and OFF_time1 (off-time) as well as the main pulse may be varied.

Figure 8:
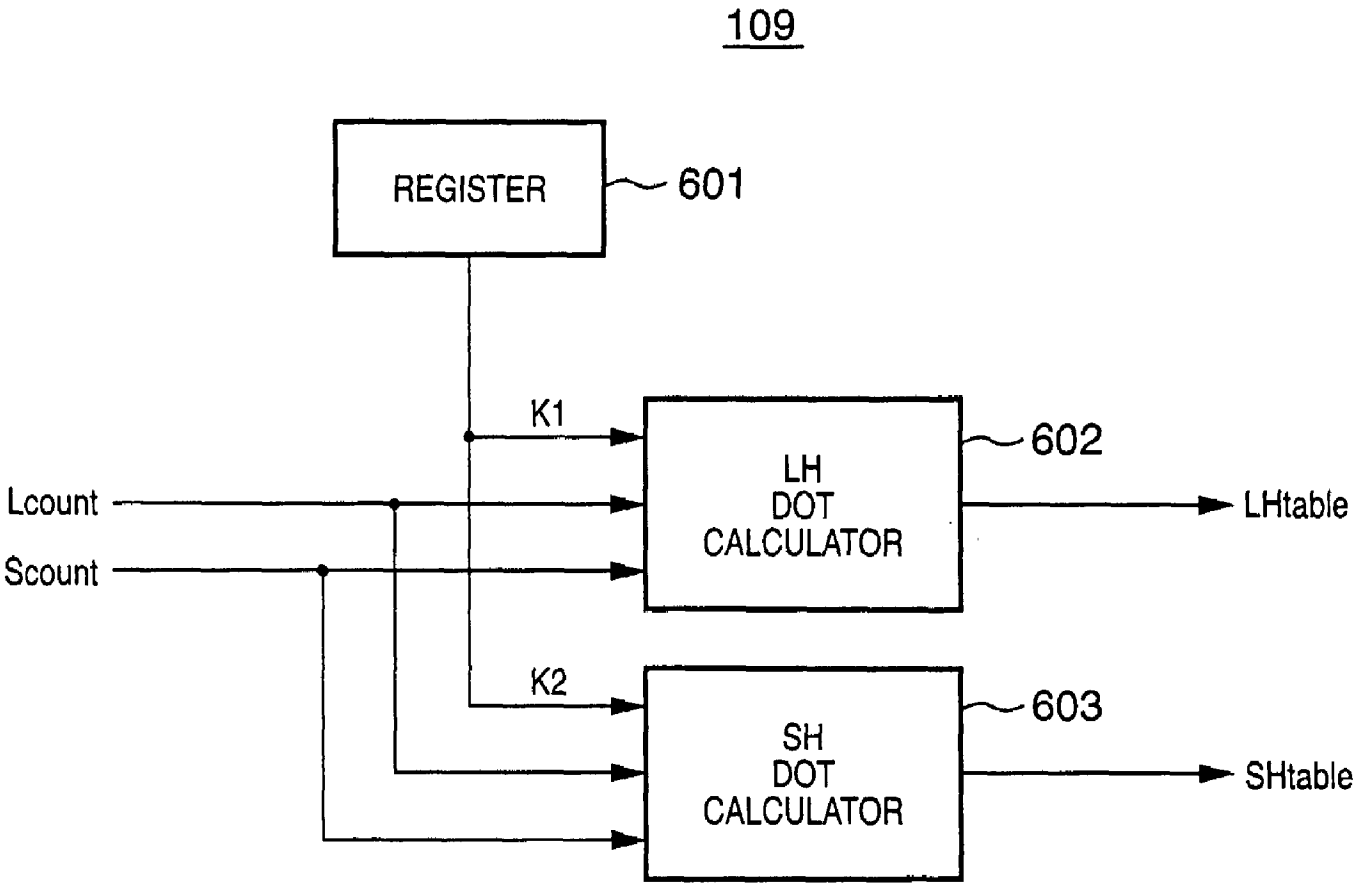
FIG. 8 is a block diagram showing the internal construction of a dot calculator 109.

FIG. 8 is a block diagram showing the internal construction of the dot calculator 109.

In FIG. 8, a coefficient K1 used for multiplication of the Lcount and a coefficient K2 used for multiplication of the Scount inputted from the dot counter 108*a* are set in a register 601. These coefficients are rewritable by the CPU 110.

The coefficients K1 and K2 are respectively inputted into the L heater (LH) dot calculator 602 and the S heater (SH) dot calculator 603. Using Lcount and Scount inputted into the respective calculators, the LH dot calculator 602 calculates Lcount+K1* Scount, and the SH dot calculator 603 calculates K2* Lcount+Scount. The result of calculation from the LH dot calculator 602 is outputted as L heater pulse table number (LHtable), and the result of calculation from the SH dot calculator 603 is outputted as S heater pulse table number (SHtable), to a heat table 111'.

FIG. 9 is a table showing the coefficients selected based on the values set in the register 601.

In FIG. 9, for example, if "11" for the L heater and "11" for the S heater are set as the register values, 12/8 is employed as an S heater dot calculation coefficient (K2) and 5/8 is employed as an L heater dot calculation coefficient (K1).

These values are determined based on the respective heater resistor values. In this embodiment, the ratio of heater resistor values (L heater:S heater) is about 12:5.

For example, if Lcount=8 and Scount=6 hold, $8+6*5/8 \cong 11$ holds as the result (LHtable) of calculation by the LH dot calculator 602, and $8*12/8+6 \cong 18$ holds as the result (SHtable) of calculation by the SH dot calculator 603.

Note that in this embodiment, fractions below decimal point are discarded, however, they may be rounded up or rounded off.

The heat table 111' is referred to using the results of calculation obtained as above.

FIG. 10 is a table showing the internal structure of the heat table 111'.

The heat table 111' is referred to using the outputs from the dot calculator 109, LHtable and SHtable. For example, in the above-described example, if LHtable=11 holds, a pulse table No. "11" shown FIG. 10 is addressed and the corresponding L heater ON_Time2 is read, and if SHtable=18 holds, a pulse table No. "18" is addressed, and the corresponding S heater ON_Time2 is read. That is, the main pulse width for L heater is 2.20 μs and the main pulse width for S heater is 2.14 μs.

The read values are fed back to the sequence controller 104, and the pulses of heat signal (Heat Sig) are generated based on the values and supplied to the printhead.

Next, print control processing in the printing apparatus having the above-described construction will be described with reference to the flowchart of FIG. 11.

Figure 11:
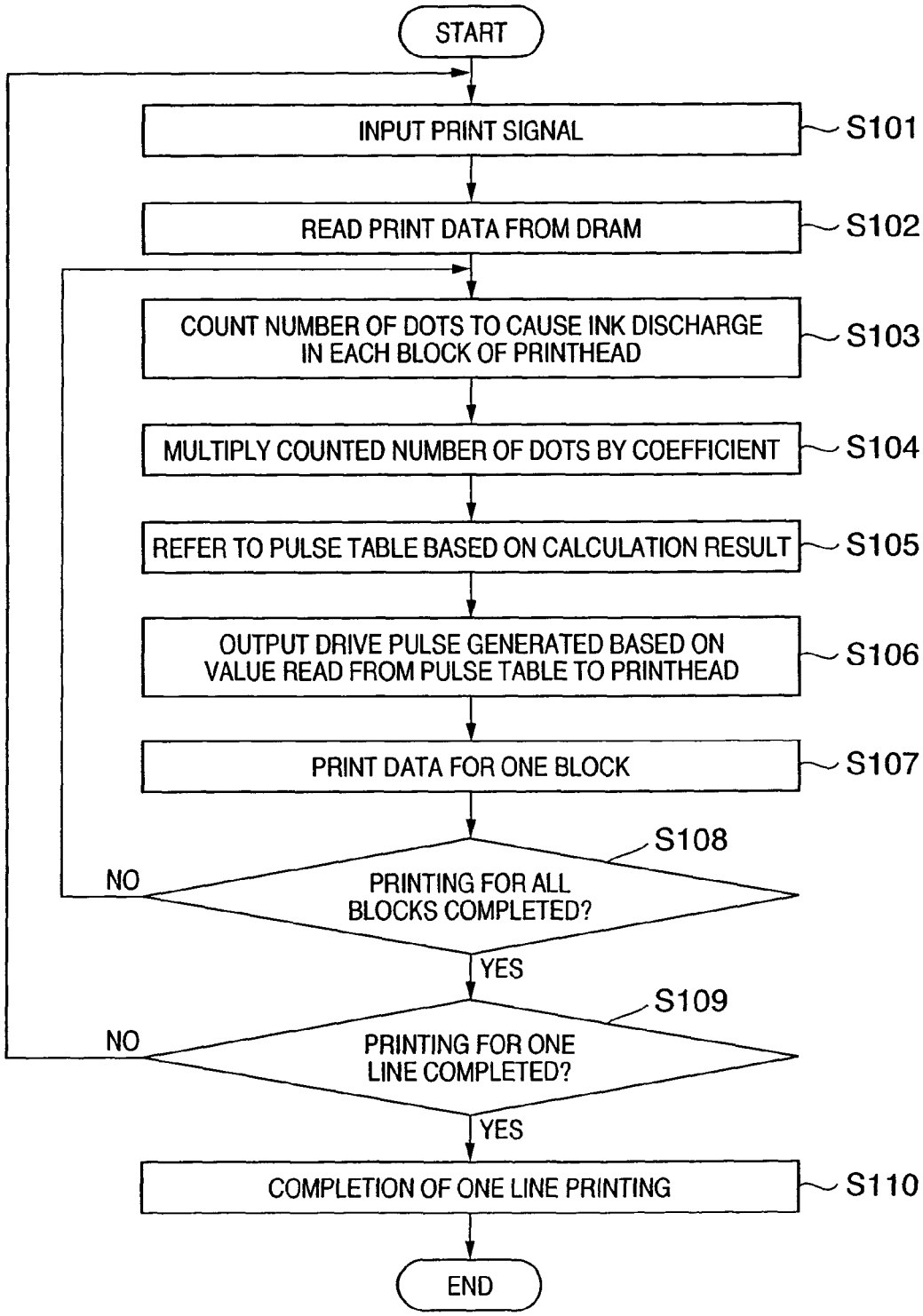
FIG. 11 is a flowchart showing print control processing for drive pulse generation.
Figure 12:
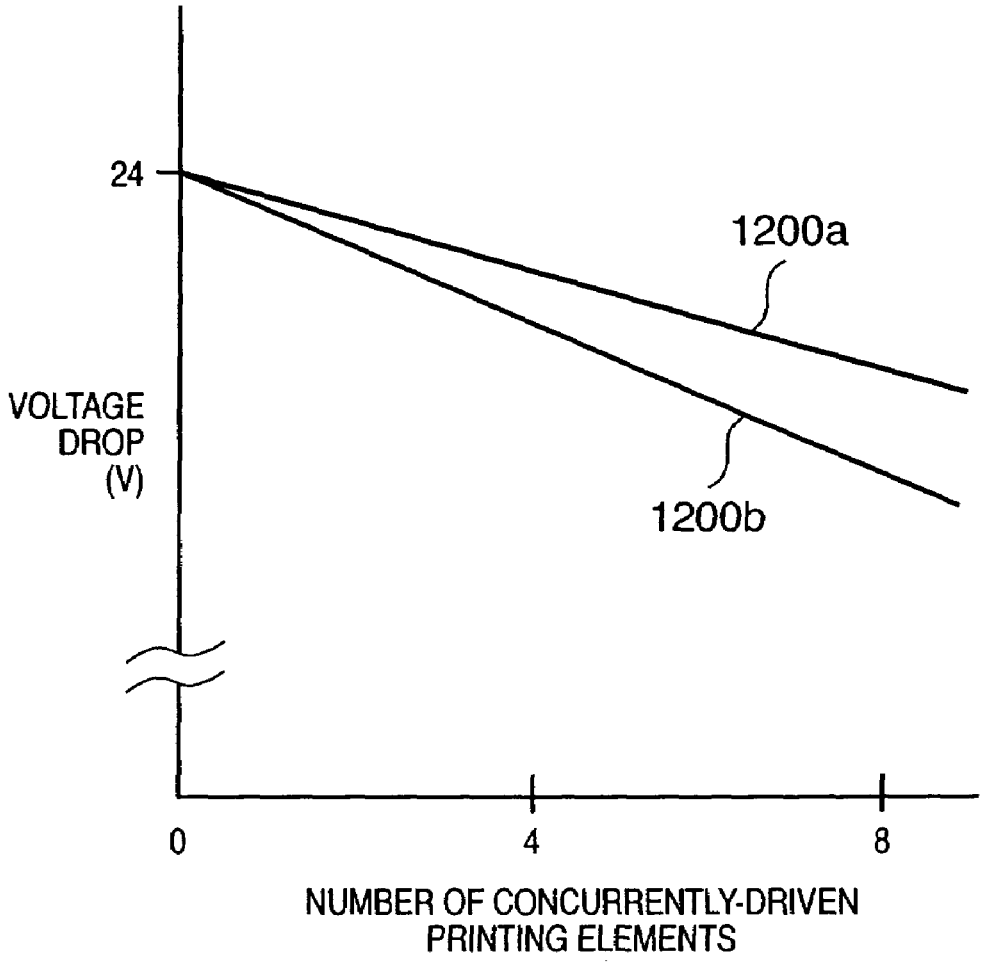
FIG. 12 is a graph showing the relation between the number of concurrently-driven printing elements and the voltage drop.

FIG. 11 is a flowchart showing print control processing for drive pulse generation.

First, at step S101, a print signal is inputted from the host PC 106 and temporarily stored into the DRAM 101. Next, at step S102, the sequence controller 104 reads the print signal held in the DRAM 101 via the DMA controller 102 upon heat timing based on the encoder signal generated by the encoder 14.

At step S103, the dot counter 108*b* counts the number of dots which cause ink discharge in one of the respective blocks of the printhead, based on the read print signal, and at step 5104, the dot calculator 109 multiplies the counted number of dots by the above-described coefficients. Then at step S105, in correspondence with the values (LHtable and SHtable) resulted from the multiplication, a parameter value (in this embodiment, the main pulse width is ON_Time2) for defining the drive pulse is read from the heat table 111'.

At step S106, the sequence controller 104 generates heat pulses with the read main pulse width, and transfers the heat pulses with the L heater print signal (P-Data1) and the S heater print signal (P-Data2) to the head logic 105 in the printhead 1. At step S107, printing is performed for one block of printing elements in the printhead 1.

At step S108, it is determined whether or not the printing operation for all the 16 blocks of the printhead has been completed. If the printing operation has not been completed, the process returns to step S103, at which the number of dots for ink discharge in the next block is counted.

On the other hand, if the printing operation has been completed, the process proceeds to step S109, at which it is determined whether or not printing for one scanning of the printhead has been completed. If it is determined that the printing has not been completed, the process returns to step S102, at which the printing is continued after input of the next heat timing. On the other hand, if it is determined that the printing has been completed, the process ends.

As described above, according to the embodiment, even in a case where printing is performed by using a printhead having heaters for discharging large size ink droplets and heaters for discharging small size ink droplets, optimum drive pulses are applied to the respective heaters in correspondence with the number of concurrently-driven heaters. This arrangement controls voltage drop which occurs in the respective printing elements, and this results in stable printing density.

Note that in the above-described embodiment, the printhead performs printing using large and small sizes of ink droplets, however, even in a case where printing is performed using more sizes of ink droplets, similar advantages can be attained by performing dot counting by using the dot counters corresponding to the number of sizes of ink droplets.

Further, in the printhead according to the above-described embodiment, the large diameter nozzles for discharging large size ink droplets and the small diameter nozzles for discharging small size ink droplets are alternately arranged in the nozzle array direction, and the large diameter nozzles and the small diameter nozzles are respectively provided with heaters for discharging large size ink droplets and heaters for discharging small size ink droplets. However, the present invention is not limited to this printhead. For example, the present invention is applicable to a printhead where each nozzle has a heater for discharging large ink droplets and a heater for discharging small ink droplets such that different sizes of ink droplets can be discharged from each nozzle by drop modulation.

Note that in the above embodiment, the liquid discharged from the printhead has been described as ink, and the liquid contained in the ink tank has been described as ink. However, the liquid is not limited to ink. For example, the ink tank may contain processed liquid or the like discharged to a print medium to improve fixability or water repellency of a printed image or to increase the image quality.

The embodiment described above comprises means (e.g., an electrothermal transducer) for generating heat energy as energy utilized upon execution of ink discharge, and adopts the method which causes a change in the state of ink by the heat energy, among the inkjet printing method. According to this printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called on-demand and continuous types. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention.

Furthermore, as a full line type printhead having a length corresponding to the width of a maximum print medium which can be printed by the printer, either the arrangement which satisfies the full-line length by combining a plurality of printheads as disclosed in the above specification or the arrangement as a single printhead obtained by forming printheads integrally can be used.

In addition, the present invention may employ not only a cartridge type printhead, in which an ink tank is integrally arranged on the printhead itself, but also an exchangeable chip type printhead which can be electrically connected to the apparatus main unit and can receive ink from the apparatus main unit upon being mounted on the apparatus main unit.

It is preferably to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and prelimary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

In addition, the ink-jet printer of the present invention may be used in the form of a copying machine combined with a reader, and the like, or a facsimile apparatus having a transmission/reception function, in addition to an integrally-provided or stand-alone image output terminal of an information processing equipment such as a computer.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing printing by discharging ink from an ink-jet printhead, having plural printing elements capable of discharging ink droplets in plural sizes, to a print medium, comprising:

input means for inputting print data;

count means for counting a number of concurrently-driven printing elements corresponding to a respective size of the plural sizes, based on the print data inputted by said input means, said count means comprising first and second counters;

determination means for determining a drive pulse applied to the concurrently-driven printing elements corresponding to the respective size of the plural sizes, based on the result of counting by said count means; and print means for performing printing by applying the drive pulse determined by said determination means to the concurrently-driven printing elements, wherein the plural printing elements are divided into plural blocks, said print means comprises time-divisional drive means for time-divisionally driving the plural printing elements in block units, and said count means counts the number of concurrently-driven printing elements in the block units, said first counter counting the number of concurrently-driven printing elements, among a first group of printing elements corresponding to discharge of a first size of ink droplets, in block units, and said second counter counting the number of concurrently-driven printing elements, among a second group of printing elements corresponding to discharge of a second size of ink droplets.

2. The apparatus according to claim 1, wherein said determination means determines a waveform of a double pulse applied to the first group of printing elements and the second group of printing elements, based on the result of counting by said first counter and the result of counting by said second counter.

3. The apparatus according to claim 2, wherein the waveform of the double pulse is determined by determining a main pulse width.

4. The apparatus according to claim 2, wherein said determination means comprises:

first weighting means for weighting the result of counting by said first counter and the result of counting by said second counter, for determination of the waveform of the double pulse applied to the first group of printing elements; and second weighting means for weighting the result of counting by said first counter and the result of counting by said second counter, for determination of the waveform of the double pulse applied to the second group of printing elements.

5. The apparatus according to claim 4, wherein the weighting by said first and second weighting means is performed in accordance with a ratio of a heater resistance of the first group of printing elements to that of the second group of printing elements.

6. The apparatus according to claim 4, further comprising storage means for storing plural main pulse widths, wherein said determination means accesses said storage means based on the result of weighting by said first weighting means to determine a main pulse width to be applied to the first group of printing elements, and accesses said storage means based on the result of weighting by said second weighting means to determine a main pulse width to be applied to the second group of printing elements.

7. The apparatus according to claim 6, wherein the weighting by said first and second weighting means is performed in accordance with a ratio of a heater resistance of the first group of printing elements to that of the second group of printing elements.

8. The apparatus according to claim 1, wherein said ink-jet printhead has a nozzle array in which a first type of nozzle to discharge the first size of ink droplets and a second type of nozzle to discharge the second size of ink droplets are alternately arrayed.

9. The apparatus according to claim 8, wherein the first type of nozzle has a first type of electrothermal transducer to generate thermal energy to be supplied to ink for discharging the first size of ink droplets utilizing the thermal energy, and the second type of nozzle has a second type of electrothermal transducer to generate thermal energy to be supplied to ink for discharging the second size of ink droplets utilizing the thermal energy.

10. A print control method for performing printing by discharging ink from an ink-jet printhead, having plural printing elements capable of discharging ink droplets in plural sizes, to a print medium, comprising:

an input step of inputting print data;

a count step of counting a number of concurrently-driven printing elements corresponding to a respective size of the plural sizes, based on the print data inputted at said input step, said count step comprising first and second counter steps;

a determination step of determining a drive pulse applied to the concurrently-driven printing elements corresponding to the respective size of the plural sizes, based on the result of counting at said count step; and a control step of controlling performing of printing by applying the drive pulse determined at said determination step to the concurrently-driven printing elements, wherein the plural printing elements are divided into plural blocks, said control step time-divisionally drives the plural printing elements in block units, and said count step counts the number of concurrently-driven printing elements in the block units, said first counter step counting the number of concurrently-driven printing elements, among a first group of printing elements corresponding to discharge of a first size of ink droplets, in block units, and said second counter step counting the number of concurrently-driven printing elements, among a second group of printing elements corresponding to discharge of a second size of ink droplets.

* * * * *

UNITED STATES PATENT AND TRADEMARK OFFICE

CERTIFICATE OF CORRECTION

PATENT NO. : 6,969,155 B2
APPLICATION NO. : 10/620352
DATED : November 29, 2005
INVENTOR(S) : Umezawa It is certified that error appears in the above-identified patent and that said Letters Patent is hereby corrected as shown below:

ON THE COVER PAGE
At Item (57), Abstract, line 4, "Unop" should read --Upon--.
At Item (57), Abstract, line 11, "ont he" should read --on the--.

COLUMN 1
Line 7, "§119from" should read --§119 from--.

COLUMN 2
Line 2, "($V_{drop_}$n)" should read --($V_{drop_n}$)--.
Line 3, $V_{drop_}$n=R*nI." should read --$V_{drop_n}$=R*nI.--.

COLUMN 11
Line 25, "preferably" should read --preferable--.

Signed and Sealed this

First Day of August, 2006

JON W. DUDAS
*Director of the United States Patent and Trademark Office*